US005615625A

United States Patent [19]

Cassidy et al.

[11] Patent Number: 5,615,625

[45] Date of Patent: Apr. 1, 1997

[54] SYSTEM FOR THE SECURE TRANSPORTATION OF ARTICLES

[75] Inventors: Gerald A. Cassidy; Khathutshelo S. Netshisaulu; Aharon Lubashevsky, all of Transvaal, South Africa

[73] Assignee: First National Bank of Southern Africa Limited, South Africa

[21] Appl. No.: 276,913

[22] Filed: Jul. 19, 1994

[51] Int. Cl.[6] ..... E05G 1/00

[52] U.S. Cl. ..... 109/45; 109/47; 109/24.1; 194/202; 194/901; 221/154; 232/15; 340/825.31

[58] Field of Search ..... 109/19, 20, 22–25, 109/29, 45–47, 53, 55, 56, 58.5, 59, 63.5, 66, 73; 232/15, 16, 1 D; 70/63; 194/202, 350, 901; 221/154, 197, 198, 287; 271/149, 150, 160, 162–164; 340/541, 542, 572, 673, 825.31–825.36

[56] References Cited

U.S. PATENT DOCUMENTS

| | | | |
|---|---|---|---|
| 3,665,160 | 5/1972 | Lopata | 109/23 X |
| 4,341,100 | 7/1982 | Kohlhage | 70/63 |
| 4,372,478 | 2/1983 | Gomez et al. | 232/15 X |
| 4,471,905 | 9/1984 | Sloma et al. | 232/15 X |
| 4,540,106 | 9/1985 | Fukatsu | 109/24.1 X |
| 4,548,353 | 10/1985 | Howard et al. | 232/4 |
| 4,655,368 | 4/1987 | Bateman et al. | 109/45 X |
| 4,755,011 | 7/1988 | Seroka et al. | 109/47 X |
| 4,845,484 | 7/1989 | Ellsberg | 221/154 X |
| 4,955,532 | 9/1990 | Kanehara et al. | 232/16 X |
| 5,056,643 | 10/1991 | Kirberg | 194/202 |
| 5,224,579 | 7/1993 | Brown | 232/16 X |
| 5,229,648 | 7/1993 | Sues et al. | 340/825.31 X |
| 5,234,209 | 8/1993 | Weigel et al. | 221/198 X |
| 5,259,491 | 11/1993 | Ward, II | 232/16 X |
| 5,260,694 | 11/1993 | Remahl | 340/572 X |

FOREIGN PATENT DOCUMENTS

| | | | |
|---|---|---|---|
| 0021670 | 1/1981 | European Pat. Off. | E05B 49/00 |
| 0030413 | 6/1981 | European Pat. Off. | G07F 7/02 |
| 0099762 | 2/1984 | European Pat. Off. . | |
| 0104072 | 3/1984 | European Pat. Off. | E05B 47/00 |
| 0139059 | 5/1985 | European Pat. Off. | E05B 49/00 |
| 0268909 | 6/1988 | European Pat. Off. | E05B 49/00 |
| 0282339 | 9/1988 | European Pat. Off. | E05B 49/00 |
| 0323344 | 7/1989 | European Pat. Off. . | |
| 0372285 | 6/1990 | European Pat. Off. | G07C 9/00 |
| 0393444 | 10/1990 | European Pat. Off. . | |
| 2617530 | 1/1989 | France . | |
| 2633653 | 1/1990 | France . | |
| 2814410 | 10/1978 | Germany | 109/25 |
| 3906808 | 12/1989 | Germany | 109/25 |
| 1576567 | 10/1980 | United Kingdom | E05G 1/12 |
| 2236143 | 3/1991 | United Kingdom | E05G 7/00 |
| 8000887 | 5/1980 | WIPO | G07D 9/00 |
| 8703034 | 5/1987 | WIPO | E05G 1/00 |
| 8902968 | 4/1989 | WIPO | E05B 49/00 |

*Primary Examiner*—Suzanne L. Dino
*Attorney, Agent, or Firm*—Ladas & Parry

[57] ABSTRACT

A system for the secure transportation of articles such as cheques and bank notes comprises first and second docking stations at different locations, and a secure container which mates with the docking stations. The container has a number of lockable doors into which bank notes are fed by a feeder mechanism at the first docking station. The container has its own microcontroller which monitors the status of the doors and the integrity of the container, and which can respond to external control signals while it is in transit. Once the container has been loaded at one docking station, it is transported to the second docking station at a different location, where it can be unloaded. A one-time code is generated each time the container is loaded, and must be communicated to the second docking station before the container can be unloaded. Any attempt to tamper with the container while it is in transit results in the activation of a dye dispenser, which marks the contents of the container.

14 Claims, 6 Drawing Sheets

SYSTEM FOR THE SECURE TRANSPORTATION OF ARTICLES

BACKGROUND OF THE INVENTION

THIS invention relates to a secure system for the transportation of articles such as cheques, banknotes or other valuable articles.

The transportation of valuable articles, especially cash, has become increasingly dangerous. Even the use of armed guards and armoured vehicles is proving inadequate to safeguard valuable articles from robbers while in transit, or front theft or fraud on the part of employees handling the articles. As result, there is a need for increasingly sophisticated systems for safeguarding valuable articles in transit.

SUMMARY OF THE INVENTION

According to the invention a system for the secure transportation of articles comprises first and second docking stations at respective different locations, and a container for articles, each docking station comprising:

a housing defining a port for receiving the container;

locating means for locating the container in a predetermined position in the port;

feed means for receiving articles and feeding them into an opening in the container; and control means for controlling and monitoring the operation of the docking station and for generating a record of articles fed into the container, the container comprising:

a housing having at least one opening for receiving articles from the feed means of the docking station;

closure means for closing the at least one opening lockably;

first operating means for selectively locking and unlocking the closure means while the container is received by the port of the docking station; and monitoring memos for monitoring the integrity of the container in use and for generating an alarm signal if the container is operated in an unauthorised manner.

The port in the docking station for receiving the container is preferably an opening extending into the housing which is sized to receive the container.

The locating means may comprise a tray for supporting the container in the opening and indexing means for maintaining the container at a desired one of a plurality of predetermined positions relative to the opening.

The feed means is preferably a device for feeding sheets such as bank notes or cheques into the container.

The docking station preferably includes second operating means engagable with the first operating means of the container to lock or unlock the closure means of the container selectively under the control of the control means.

The control means may include data acquisition means associated with the feed means for reading and storing data identifying articles fed into the container.

The control means may include communication means for transferring data between one docking station and another, and between a docking station and a container received therein.

The monitoring means of the container and the control means of the docking station are preferably adapted to communicate so that an access code entered at the first docking station during loading of the container can be stored by the monitoring means of the container, the access code being transmitted independently to the second docking station and being entered therein when the container is received at the second docking station, the monitoring means of the container communicating with the control means of the second docking station to compare the stored and entered access codes and the control means allowing unlocking of the closure means of the container only if the stored and entered access codes correspond.

The invention extends to the docking station and the container independently.

DESCRIPTION OF AN EMBODIMENT

Figure 1:
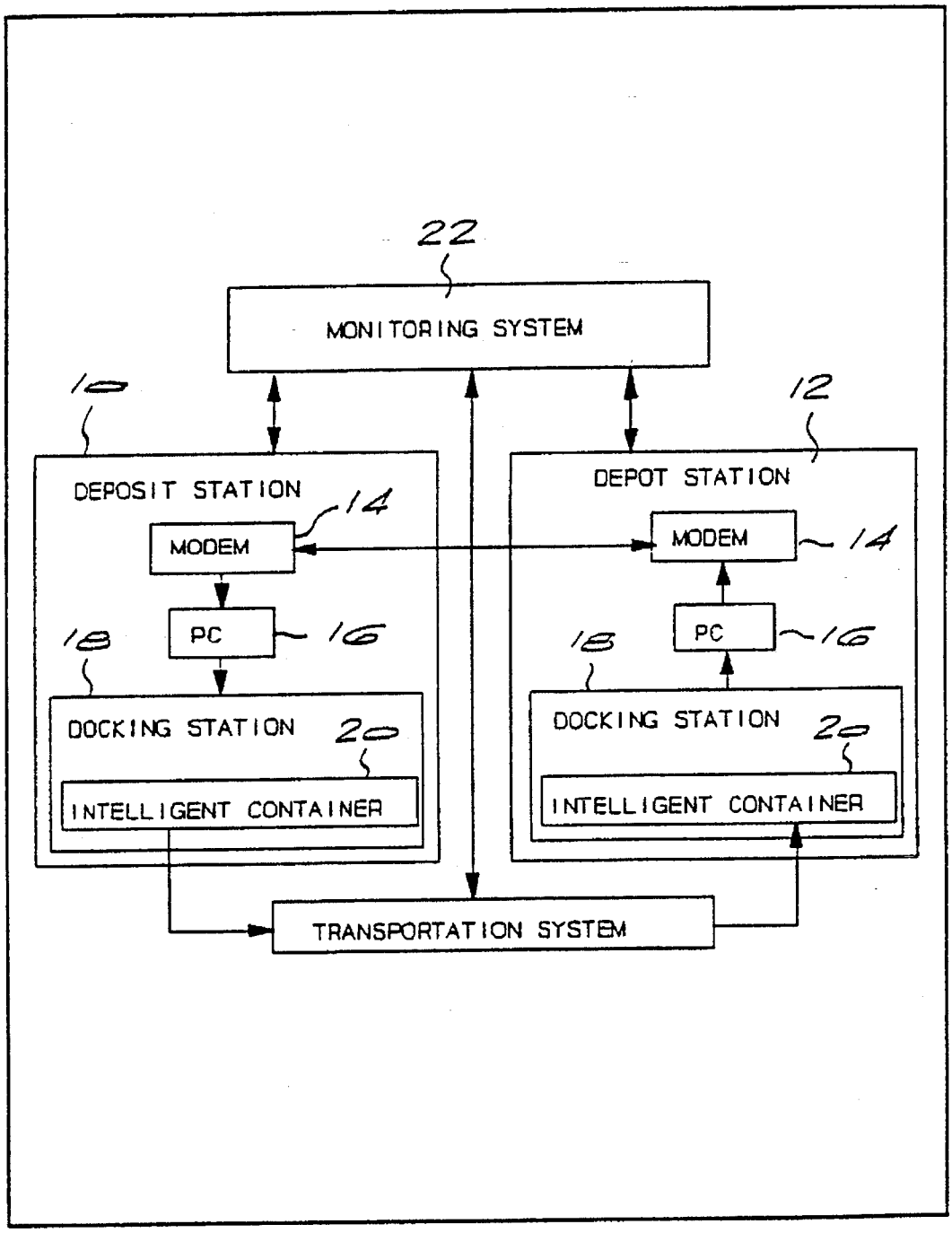
FIG. 1 is a block diagram of a system for the secure transportation of articles according to the invention.

The system block diagram of FIG. 1 shows a deposit station 10 which is typically located at the premises of a business, for example, and a depot station 12 which is typically located at the premises of a bank or another financial institution. However, the deposit station and the depot station can be anywhere. Both the deposit station 10 and the depot station 12 have modems 14 which are in communication with one another, for example, via a telephone or telecommunications network.

The modems 14 are connected to respective computers 16, which are in turn connected to docking stations 18, each of which can receive secure "intelligent" containers 20. The containers 20 are transported between the deposit station 10 and the depot station via a transportation system, which may be a conventional system using armoured vehicles or the like. An overall monitoring system 22 monitors the operation of the docking stations 18 at the deposit station 12, and also monitors the status of the intelligent containers 20 while they are in transit in the transportation system.

In FIG. 1, the modems 14 and computers 16 are shown as being separate from the respective docking stations 18. However, these components can be included in the docking stations. The computers 16 need not be free-standing personal computers, but can comprise, for example, a computer motherboard with a disc drive, connected to the other circuitry of the docking stations.

Figure 2:
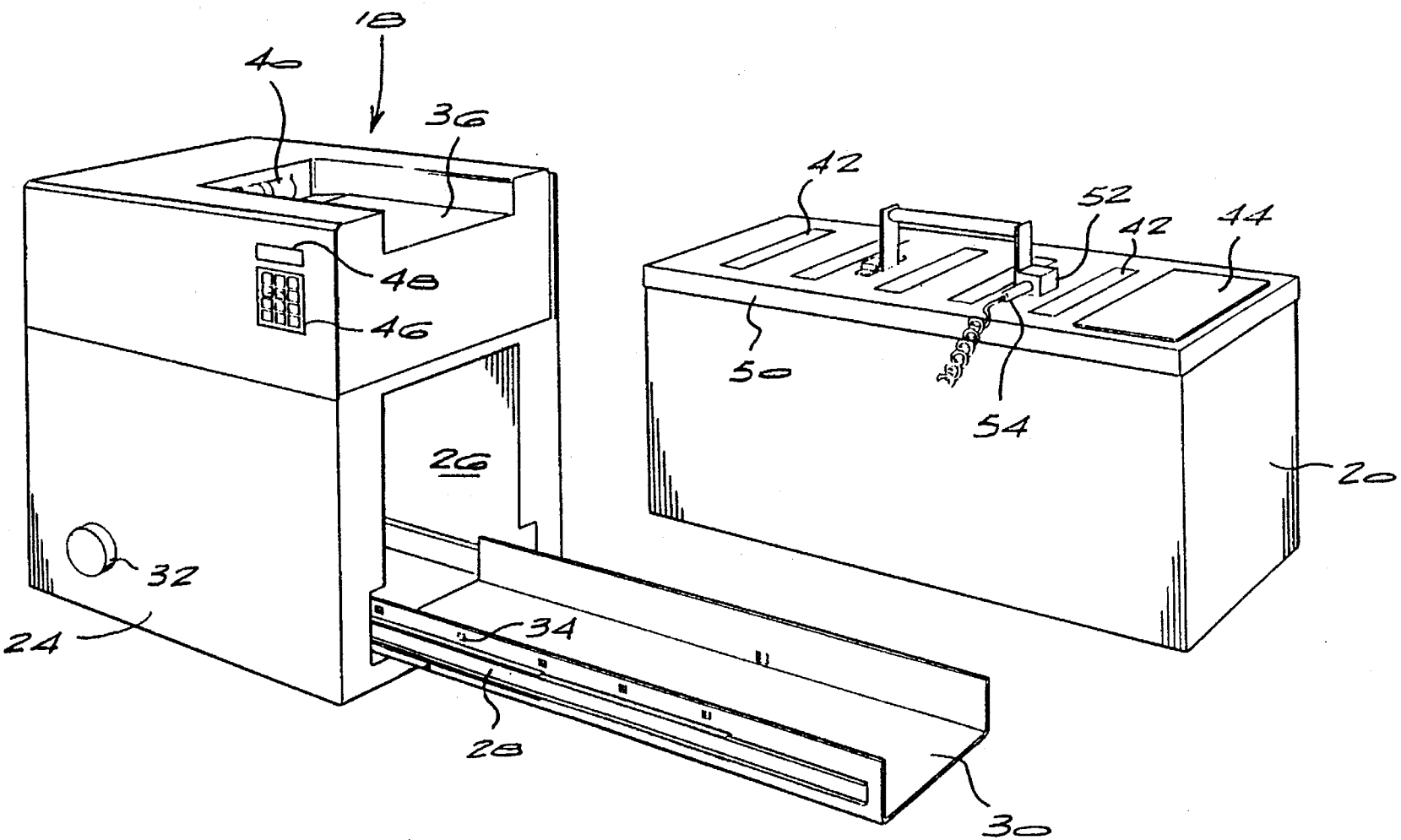
FIG. 2 is a pictorial view of a docking station and an "intelligent" container according to the invention.

Referring now to FIG. 2, a single docking station 18 and a secure "intelligent" container 20 are shown. The docking station comprises a housing 24 with an opening 26 formed therein which extends right through the housing and which is sized to receive the container 20. Mounted on telescoping rails 28 which extend from the interior of the opening 26 is a folded sheet metal tray 30 into which the container 20 can be placed. The container can then be pushed into the interior of the docking station. A knob 32 on the side of the docking station housing operates an indexing mechanism which engages spaced apart apertures 34 in the edge of the tray 30, to move the container selectively between several predetermined positions within the docking station.

Figure 3:
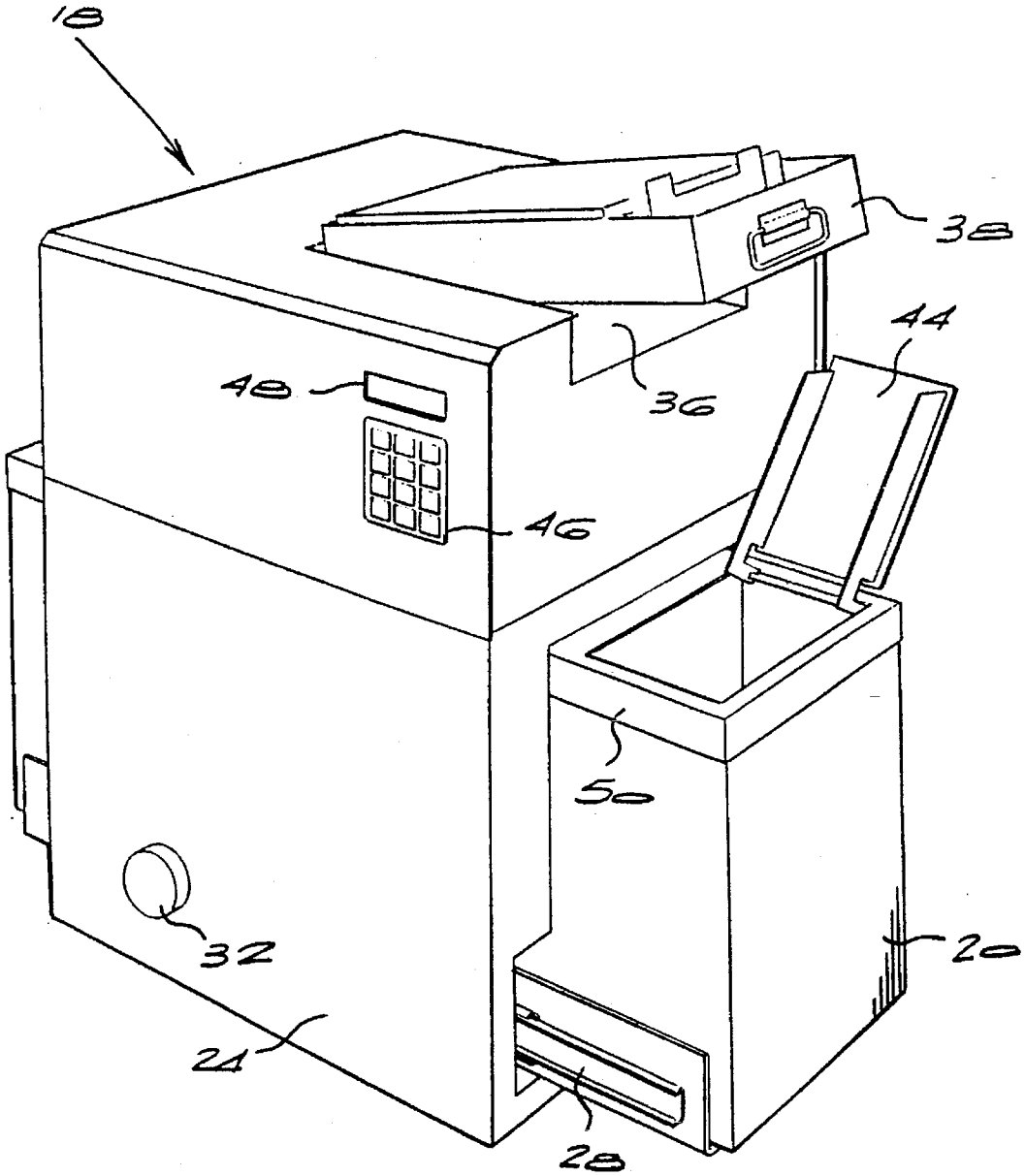
FIG. 3 shows the container received in the docking station.

The top surface of the docking station defines a tray 36 for a cassette 38 (see FIG. 3) which has been preloaded with valuable articles such as bank notes or cheques. At the inner end of the tray 36 is a set of feed rollers 40 which can either feed cheques or bank notes one at a time into the interior of the docking station, or which feed the bank notes or cheques from the cassette 38.

The secure container 20 is built sturdily from mild steel or hardened plastics and has a number of compartments which are accessed via respective electronically controlled sliding doors 42. A larger compartment with its own door 44 is provided at one end of the container.

When the container is mounted in the tray 30 and inserted into the docking station, one or the other of the compartments in the container is aligned with a feed mechanism which includes the feed rollers 40, and the respective door 42 is opened by a solenoid mechanism within the container to allow the notes or cheques to be fed into the compartment.

Associated with the feed mechanism is an optical character recognition unit and a counting device which both verifies the authenticity of bank notes and reads their denomination, and which also reads the MICR data from cheques. This information is stored in a control circuit of the docking station.

As each compartment of the container is filled, the container is indexed to the next point on the tray.

Apart from cheques and bank notes, coins, merchant credit card vouchers and withdrawal cheques are deposited in the container, via the door 44.

Figure 4:
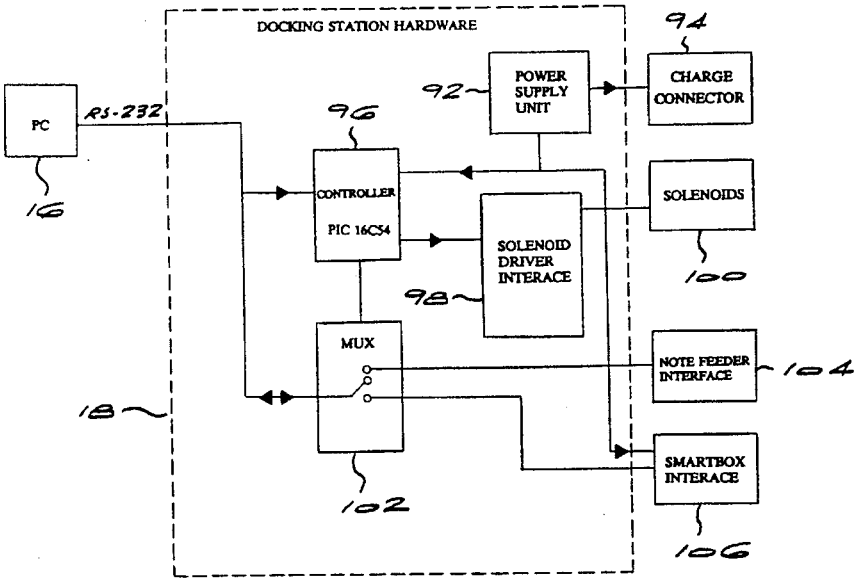
FIGS. 4 & 5 are simplified block diagrams of the electronic circuitry of the docking station and the container, respectively.

The electronic circuit of the docking station is illustrated in the simplified block diagram of FIG. 4. The docking station circuitry includes a power supply unit 92 which is connected in use to a power source such as an AC mains outlet or an internal battery, and which both supplies the electronic circuitry of the docking station and provides a battery charging output for the internal battery of the secure container 20 via a connector socket 94. The docking station is controlled by a main micro-controller 96, which in the prototype was a PIC 16C54. The controller 96 controls a solenoid driver interface 98 which powers a plurality of solenoids 100 in the secure container 20, to open and close the respective doors 42 and 44 of the container. Via a multiplexer 102, the controller selects communications lines between an interface circuit 104 of the cheque/note feeder of the docking station, or an interface circuit 106 which communicates with the container 20 when the latter is in place in the docking station.

The operation of the docking station is controlled in use via a keypad 46 and its status is indicated by a liquid crystal display 48. The docking station is connected in use to a personal computer 16 via an RS 232 serial interface. (As mentioned above, the docking station could have a built-in computer instead of being linked to a separate computer). To begin the loading operation, an operator code is entered via the personal computer (PC) initialising the system and allowing notes and cheques to be deposited into the container. A record of the deposited cheques and notes is stored in the PC. The container has its own unique identity number, and this information and the time at which the deposit is completed is also stored in the PC. When the container is removed from the docking station, it is locked automatically under the control of its own electronic monitoring circuitry. A security staff member collecting the container enters the time of collection of the container and a courier reference number, and this information is transmitted to the bank or financial institution via the modem associated with the PC.

In addition, a unique one-time code is generated when the container is loaded, which is transmitted via the modem of the deposit station to the modem of the depot station. The transmitted code is encrypted for extra security. When the container is received at the depot station and loaded into the docking station 18 there, the code must be entered via the PC at the depot station to unlock the container. The lid 50 of the container is operated by a motorised mechanism in the container which is controlled by the electronic circuitry of the docking station and the monitoring circuitry of the container. The locking mechanism comprises a number of brackets which are rotated into or out of engagement with the walls of the container by the motor to lock or unlock the container.

Figure 5:
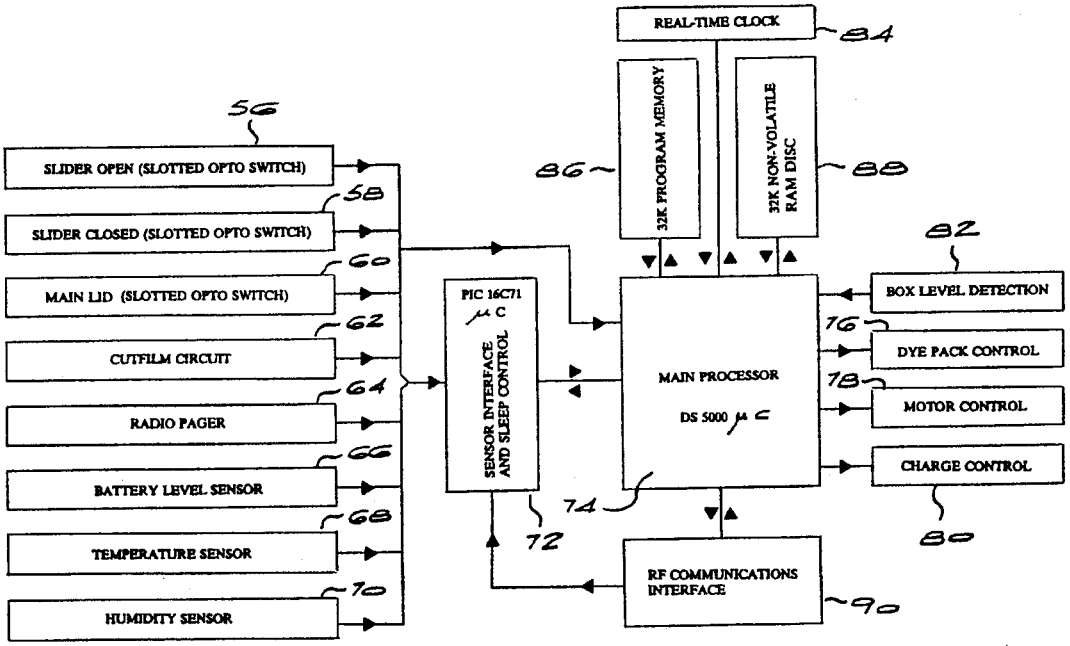

The electronic circuitry of the container is shown in the simplified block diagram of FIG. 5.

The container 20 has its own electronic monitoring system which adds to the security of the container. The monitoring circuitry monitors the state of pairs of optical sensors 56 and 58 which detect whether the respective sliding doors 42 or 44 are open or closed, as well as an optical sensor 60 which detects opening of the main lid 50 of the container. The wall of the container has a lining 62 which comprises a network of parallel foil conductors, with alternate conductors being at ground or a line voltage, so that drilling or cutting through the wall of the container will either cause a short or open circuit condition which can be detected by the monitoring circuit.

The outputs of the sensors 56 to 62 (as well as an output from a radio pager receiver circuit 64, a battery level sensor 66, a temperature sensor 68 and a humidity sensor 70) are fed to a sensor interface circuit 72. In the prototype system, this circuit comprised a PIC 16C71 microcontroller which includes four analogue to digital convertors. The analogue to digital convertors are used to convert the outputs of analogue sensors such as the battery level sensor, temperature sensor and humidity sensor to digital signals for further processing by a main processor 74, which in the prototype was a DS-5000 microcontroller. The main processor handles the communications and database management functions of the "intelligent" container. In addition, the main processor 74 provides control signals to a dye pack control circuit 76 and a motor control circuit 78, as well as a battery charged control circuit 80. The main processor 74 monitors the status of the various sensors referred to above, as well as a level sensor 82 which detects tilting of a container.

The processor 74 has a real time clock 84 and is controlled by software stored in a first memory 86, typically a preprogrammed ROM. In addition, the processor 74 has a 32 KB non-volatile random access memory 88 which is configured as a "disc" which is divided into 256 sectors of 128 bytes each. The processor 74 also controls an RF communications interface 90, which allows communication between the "intelligent" container and a remote monitoring station.

The electronic circuitry of the container is controlled by a rechargeable lead acid battery, which also controls the motorised locking mechanism of the container and the solenoids which control the sliding doors 42 and 44 via the motor control circuit 78.

The dye dispenser or dye pack in the container has an electrically actuated detonator or other explosive device which can be triggered by the dye pack control circuit 76 at the command of the main processor 74. If any of a number of possible unauthorised events occurs, the processor sends an actuation signal to the dye pack control circuit 76, which in turn detonates the explosive device in the dye pack, rendering the contents of the container unusable. If any of the sliding doors 42 or 44 are forced open, if the main lid 50 is forced open, or if the security lining of the box is damaged, the processor 74 will detect an attempt to breach the security of the container and will detonate the dye pack. In addition, if the temperature inside the box exceeds a predetermined limit (typically 60° C.) or if the humidity within the box exceeds a predetermined limit (typically 90%), the dye pack will be activated. These values respectively correspond to burning or immersion of the container.

If the battery voltage drops below a predetermined minimum level (typically 10 volts in the case of a 12 volt battery) the dye pack will also be actuated. This condition will typically correspond to theft of the container, or a situation in which the container has not reached its intended destination and has been lost. The processor 74 also monitors the time which has elapsed since the container was dispatched from the deposit station, and will detonate the dye pack when the elapsed time exceeds a predetermined limit. This limit can be preset by the user. Finally, the radio pager receiver 64 can receive a remote detonation command to detonate the dye pack. This feature can be used if it is established, for example, a vehicle transporting the container is likely to be hijacked, or in another emergency situation.

The dye used in the dye pack includes a specific combination of rare earth elements in trace quantities. Approximately 100000 combinations are possible. By recording a code corresponding to the combination used in the dye pack of each container, a bank note, cheque or other document discovered after a robbery or other event causing detonation of the dye pack can be associated with that event.

The container includes a further security system in the form of a connector socket 52 which receives a plug 54 which is connected to an identity device carried by a guard responsible for the container. The identity device has a code which is input to the monitoring circuitry of the container when the plug 54 is inserted into the socket 52, ensuring that only personnel having an identity device with the correct code can take charge of the container. The monitoring circuit may also trigger the dye dispenser if the plug 54 is removed from the socket 52 during transportation of the container. The monitoring circuit includes a timer and is arranged to trigger the dye dispenser if the container is opened before a predetermined period of time has elapsed after collection of the container. Similarly, if the container is not opened within a second predetermined time period, the dye dispenser is actuated.

Figure 6:
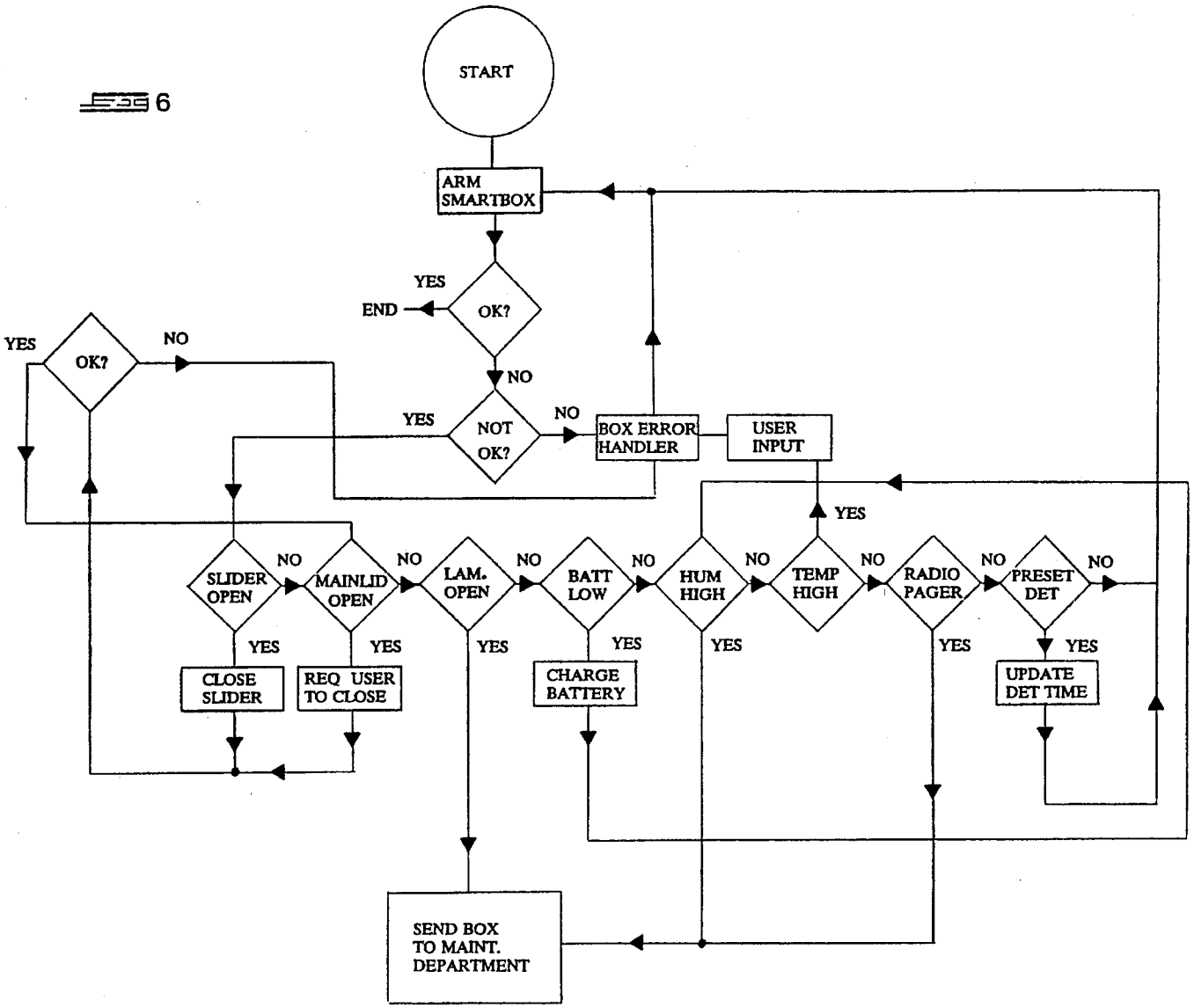
FIGS. 6 & 7 are flow diagrams illustrating the operation of the docking station and the container in use.
Figure 7:
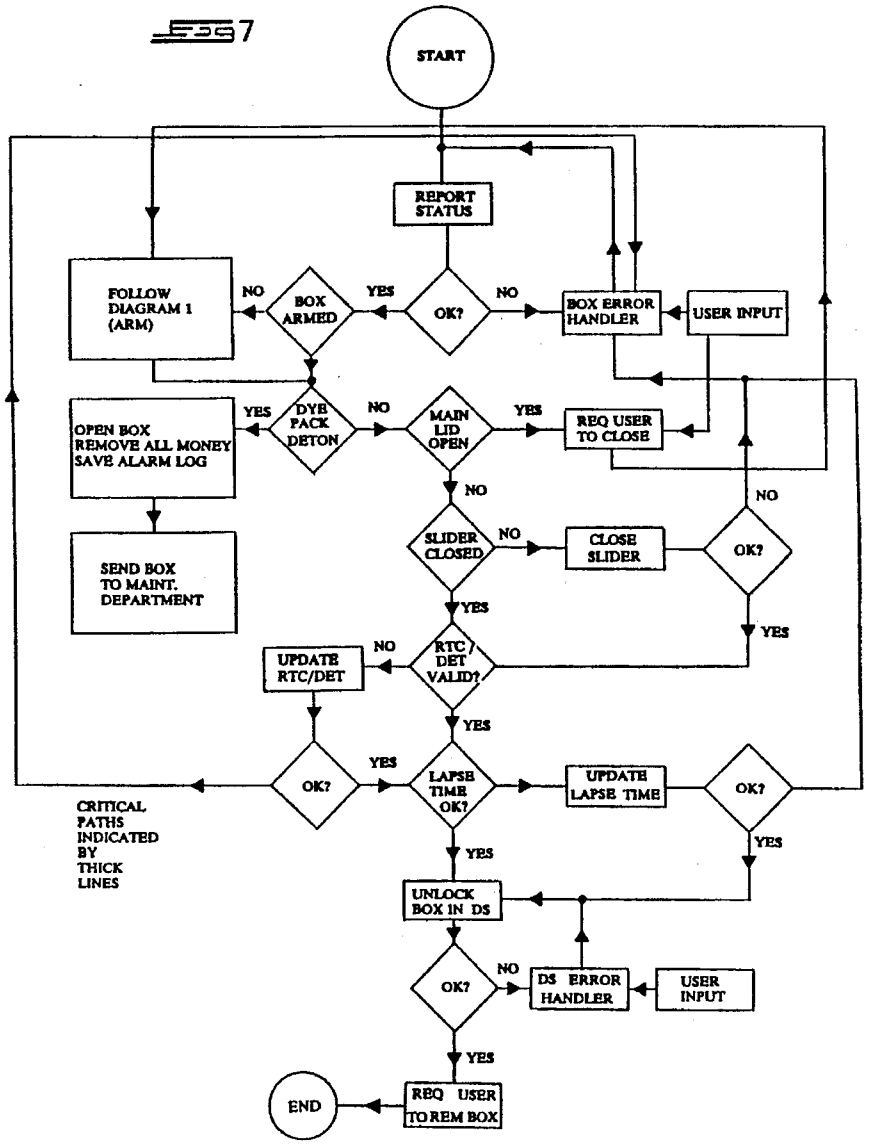

The simplified flow diagrams of FIGS. 6 and 7 indicate the operation of the intelligent container in use.

Figure 8:
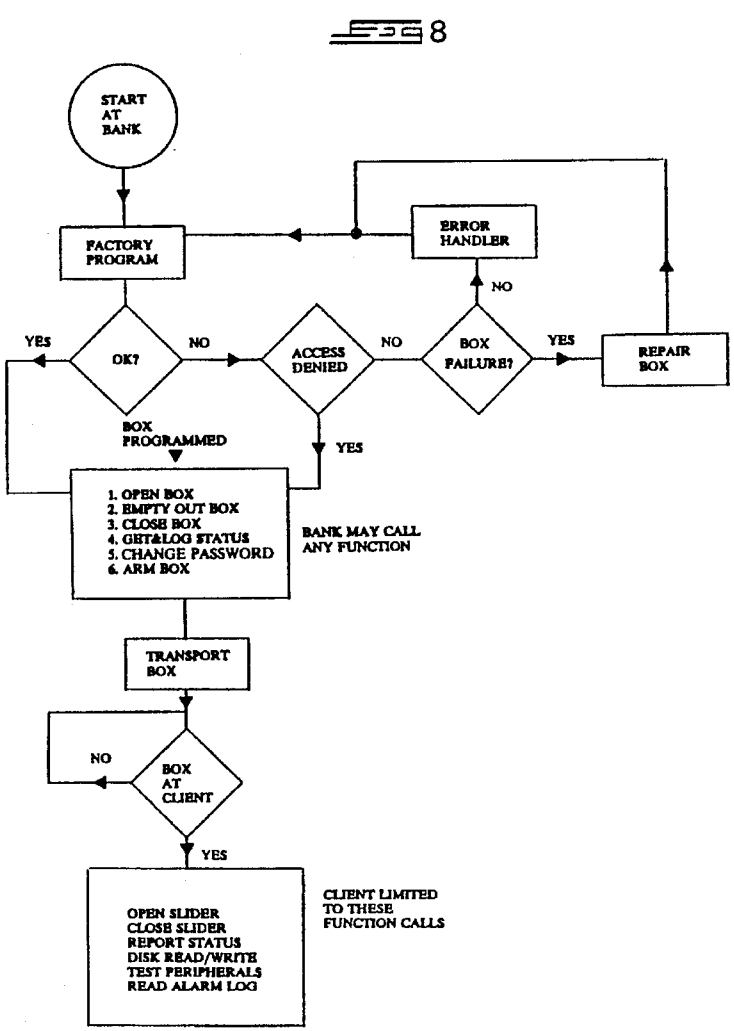
FIG. 8 is a simplified overall operational flow diagram of the system.

The simplified flow diagram of FIG. 8 summarises the overall operation of the system in use.

The system described above has a number of other useful features. For example, a panic button feature is included, allowing manual triggering of the dye pack in the container by a guard in a threatening situation. The container can include a transponder or the like which must remain within a predetermined range of transmitter in a designated transportation vehicle to prevent actuation of the dye dispenser. The vehicle or the container itself is provided with a global positioning system (GPS) receiver or another positioning system, coupled with a transmitter which transmits the position of the container to a monitoring station, so that the position of the container is monitored closely during transportation. This allows action to be taken, such as the remote actuation of the dye dispenser in the container, if the vehicle transporting the container deviates from a predetermined route.

We claim:

1. A system for the secure transportation of articles, comprising first and second docking stations at respective different locations, and a container for articles, each docking station comprising a housing defining a port for receiving the container; locating means for locating the container in a predetermined position in the port; feed means for receiving articles and feeding them into an opening in the container; control means for controlling and monitoring the operation of the docking station and for generating a record of articles fed into the container; and a communication apparatus for transmitting data between the first and second docking stations independent of the container, the data comprising an access code entered at the first docking station at the time of loading the container, the access code being required by the control means of the second docking station for unloading of the container at the second docking station, the container comprising a housing having at least one opening for receiving articles from the feed means of the docking station; closure means for closing the at least one opening lockably; first operating means for selectively locking and unlocking the closure means while the container is received by the port of the docking station; and monitoring means for monitoring the integrity of the container in use and for generating an alarm signal if the container is opened in an unauthorized manner.

2. A system according to claim 1 wherein the port in the first and second docking stations for receiving the container is an opening extending into the housing which is sized to receive the container.

3. A system according to claim 2 wherein the locating means comprises a tray for supporting the container in the opening and indexing means for maintaining the container at a desired one of a plurality of predetermined positions relative to the opening.

4. A system according to claim 1 wherein the feed means is a device for feeding sheets including bank notes or cheques into the container.

5. A system according to claim 1 wherein the first and second docking stations include second operating means engagable with the first operating means of the container to lock or unlock the closure means of the container selectively under the control of the control means.

6. A system according to claim 5 wherein the first operating means comprises at least one solenoid arranged to open and close the closure means of the container.

7. A system according to claim 5 wherein the first operating means comprises a motor arranged to operate a locking mechanism.

8. A system according to claim 5 wherein the second operating means comprises an energising circuit arranged to energise electrically the first operating means.

9. A system according to claim 1 wherein the control means includes data acquisition means associated with the feed means for reading and storing data identifying articles fed into the container.

10. A system according to claim 9 wherein the data acquisition means comprises counting means for counting the number of articles fed into the container by the feed means.

11. A system according to claim 9 wherein the data acquisition means comprises a character recognition device which reads characters on the articles fed into the container.

12. A system according to claim 1 wherein the monitoring means of the container and the control means of the docking station are adapted to communicate so that the access code entered at the first docking station during loading of the container can be stored by the monitoring means of the container, the access code being entered at the second docking station when the access code is transmitted independently to the second docking station and when the container is received at the second docking station, the monitoring means of the container communicating with the control means of the second docking station to compare the stored and entered access codes and the control means allowing unlocking of the closure means of the container only if the stored and entered access codes correspond.

13. A secure container for use in a system including at least a first and a second docking stations, each having feed means and a port for the secure transportation of articles, said container comprising:

a housing having at least one opening adapted for receiving articles from the feed means of the first docking station; closure means for closing the at least one opening lockably; first operating means for selectively locking and unlocking the closure means while said container is being received by the port of one of the at least first and second docking stations; and monitoring means for monitoring the integrity of said container in use and for generating an alarm signal if said container is opened in an unauthorized manner, said monitoring means capable of storing an access code received from the first docking station during loading of said container and used for opening said container at the second docking station.

14. A docking station for use in a system including a container for the secure transportation of articles, said docking station comprising:

a housing defining a port adapted for receiving the container; locating means adapted for locating the container in a predetermined position in the port; feed means for receiving articles and adapted for feeding them into the container; control means for controlling and monitoring the operation of said docking station and for generating a record of articles capable of being fed into the container; and communication apparatus adapted for transmitting data between said docking station and another similar docking station independent of the container, the data comprising an access code entered at said docking station where the articles are capable of being received by the container, the access code being required by the control means of said docking station where the articles are capable of being removed from the container.

* * * * *